United States Patent [19]

Brennan

[11] Patent Number: 4,787,474

[45] Date of Patent: Nov. 29, 1988

[54] ROPE CONTROLLER

[76] Inventor: Daniel F. Brennan, 512 Main St., Shauemakersville, Pa. 19555

[21] Appl. No.: 123,817

[22] Filed: Nov. 23, 1987

[51] Int. Cl.[4] ..... A62B 1/16; A62B 35/00

[52] U.S. Cl. ..... 182/7; 188/65.2

[58] Field of Search ..... 182/3, 5, 6, 7, 8, 192; 188/65.1, 65.2

[56] References Cited

U.S. PATENT DOCUMENTS

| | | | |
|---|---|---|---|
| 259,279 | 6/1882 | Rose et al. | 182/192 |
| 3,814,210 | 6/1974 | Hoffman | 182/7 |
| 4,217,847 | 8/1980 | McCloud | 188/65.1 |
| 4,546,851 | 10/1985 | Brennan | 182/7 |
| 4,560,029 | 12/1985 | Dalmaso | 182/5 |
| 4,580,658 | 4/1986 | Brda | 182/5 |

*Primary Examiner*—Reinaldo P. Machado

[57] ABSTRACT

A hand operated apparatus is disclosed for controlling, hauling in, paying out or securing a line. The apparatus includes rope engaging cammed surfaces eccentrically mounted for rotation that permit the line to move in one direction but prevents it from moving in the other direction unless lever means, acting against a spring bias, rotate the cam surfaces away from contact with the line permitting the line to run freely through the apparatus.

A fail safe position is provided in that if the lever is clutched too tightly, it will over-travel the line releasing position and engage the line on a second surface of the cam.

As an added feature a mechanism is provided for automatically engaging and disengaging the device from the bite of a line.

5 Claims, 3 Drawing Sheets

FIG. 4
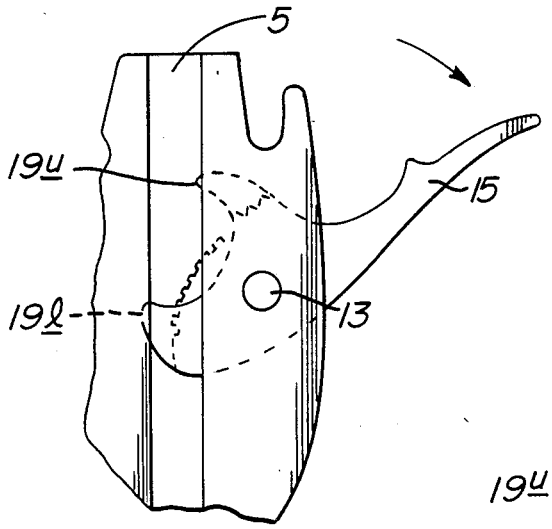
FIG. 5
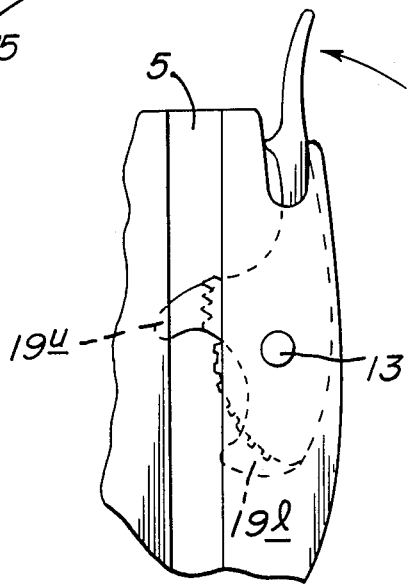
FIG. 6
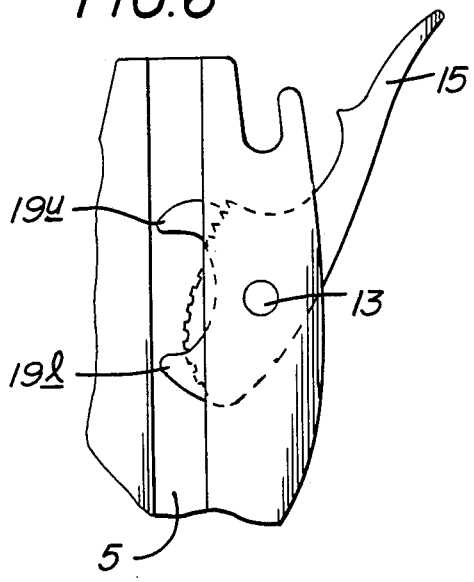
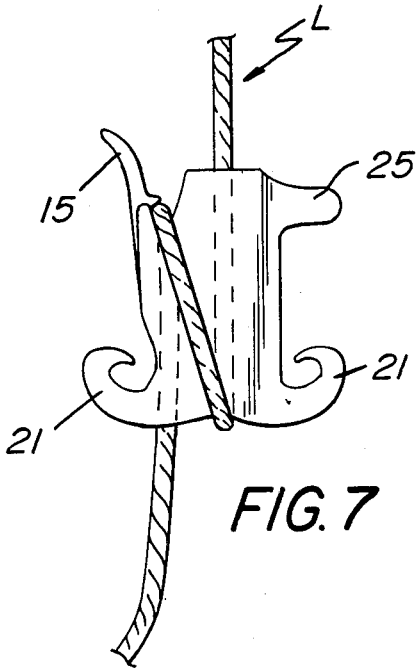
FIG. 7

ROPE CONTROLLER

CROSS-REFERENCE

There are no cross references to nor are there any related applications.

FEDERALLY SPONSORED RIGHTS

The invention herein was made without any federal sponsorship or contribution.

BACKGROUND OF THE INVENTION

1. The Field of the Invention

This invention relates to hand-operated mechanisms for controlling and securing lines and more particularly it relates to devices which will releasably secure a line in a desired position when hauling in or paying out a line under load.

2. Description of the Prior Art

Hand operated devices for controlling and securing lines that are payed out or hauled in under load are known to the prior art and have been used for a number of purposes. For example, in my prior U.S. Pat. No. 4,546,851, I disclose a device to aid a person, such as a deer hunter, in climbing a tree. Essentially this device, as is true of many others, provides means for the attachment of a harness or seat to the standing part of a line in combination with a mechanical hand operated locking device that engages the running part of the line as well as a harness or seat. The locking device is of a toothed cam sort that permits the line to move through the device in one direction but locks up and prevents the line from moving in the other direction. Because of this locking feature, the climbers seat or harness is held secure at any elevated position.

One deficiency in the type of climbing device shown in my patent, as is common with many others, is that no provision is made for paying out rope. The only way in which a climber may descend is to disengage the line from the device and then lower himself hand over hand.

A related device is illustrated in U.S. Pat. No. 4,217,847. Here is shown a so-called cam cleat for securing nautical lines, such as sail sheets. The salient feature of this device is a smooth release cam surface which allows a line under load to be released without having to haul in on the line to disengage the line from the cleat.

Other hand operated devices for controlling lines under load have been designed primarily for use with fire escape devices. Illustrative of these is U.S. Pat. No. 259,279 which describes a device which can be used by a person to lower himself from an elevated location. Note that it can not function to aid a person in climbing.

Some prior art devices of the type with which this invention is concerned are inconvenient to use because an end of the line must be threaded through the device, which is more difficult than engaging or disengaging the bight of a rope.

Those devices known in the prior art that permit a person to descend a rope usually have some sort of hand triggered mechanism that, when squeezed, will rotate toothed cams away from engagement with the rope and allow the person to descend. While this arrangement operates well as long as the user understands what he is doing, it is possible, as in a moment of panic when descending too rapidly, to clutch the trigger mechanism harder and lose all control over the rate of descent.

SUMMARY OF THE INVENTION

Accordingly, it is an object of this invention to provide a simple hand operated mechanism for paying out, hauling in or securing a line under load.

Another object of this invention is to provide a simplified device for aiding a person in climbing or descending a rope.

Another object of this invention is to provide a hand operated mechanism for controlling and securing a line under load which device can be engaged or disengaged directly on a bight of a line.

Yet another object of this invention is to provide a mechanism to aid a person in descending from an elevated position which will fail safe if the person panics.

Another object of this invention is to provide a hand operated line control mechanim including automated means for engaging the mechanism with the bight of a line.

These and other objects of this invention are achieved by providing a mechanism that has a cylindrical passageway axialy extending through the body portion adapted to receive a rope. Mounted on one side wall of the cylindrical passageway is a fixed serrated or toothed rope securing means and diametrically opposed is a toothed cam mounted for rotation about an excentric axis perpendicular to the axis of the cylindrical passageway. The cam is spring biased to rotate the cam into the bore of the passageway but, by means of a hand lever associated with the cam, the cam may be rotated away from the axis of the passageway. Much of this type of mechanism is known in the prior art.

A novel feature of my invention is an auxiliary toothed surface circumferentially displaced from the principal toothed surface of the cam. The auxiliary toothed surface is disposed so that when the hand operated lever is moved against the spring bias to rotate the principal toothed surface away from the axis of the passageway the auxiliary toothed surface will rotate in the opposite direction, that is, toward the axis of the cylindrical passageway. When the hand lever is released, the principal toothed surface will, under the action of the spring, engage a line. When the hand lever is moved against the spring bias, the line will be released by the principle toothed surface, but when further moved, the auxiliary toothed surface will engage the line. Thus the line will be secured either when the lever is released or when it is tightly gripped.

Another novel feature of this invention is a combined keeper and threading device that facilitates engaging and disengaging the mechanism of this device on the bight of a line.

BRIEF DESCRIPTION OF THE DRAWINGS

FIGS. 4, 5 and 6 are schematic views illustrating the operation of the keeper and threading elements associated with the mechanism of this invention.

FIG. 7 is a rear view of the mechanism showing a rope threaded through and ready for use.

DETAILED DESCRIPTION OF THE DRAWINGS

Figure 1:
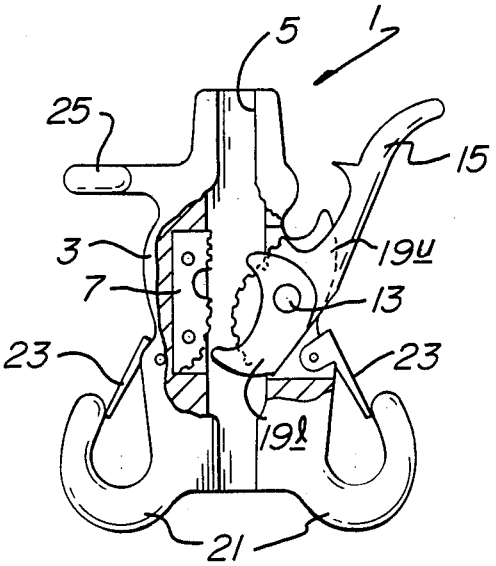
FIG. 1 is a side view, partially cut away, of the mechanism of this invention.
Figure 2:
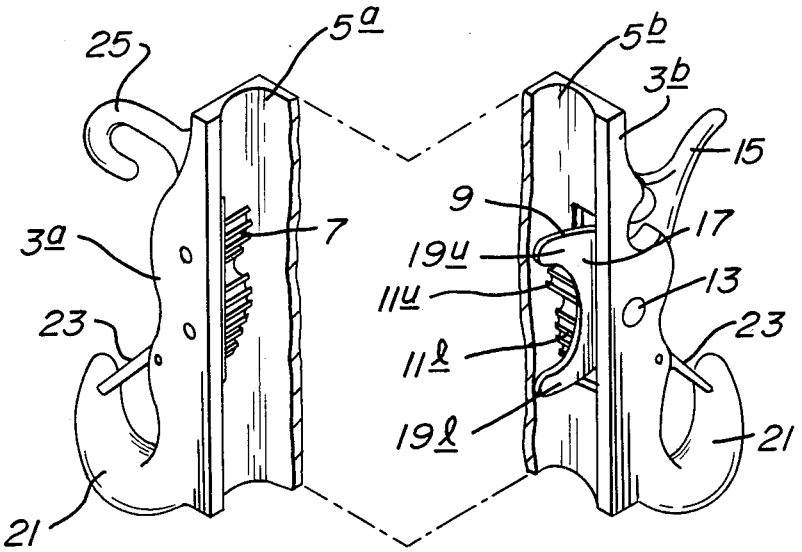
FIG. 2 is a view of the mechanism shown in FIG. 1 divided in two parts with each of the parts rotated away from each other.

With reference to FIGS. 1 and 2 the details of the hand-held line controlling and securing mechanism can be understood. The mechanism 1 is comprised of a body portion 3 through which passes an axially aligned cylindrical passageway 5. There is an opening in the side wall of the passageway 5 of sufficient width to permit the insertion of a line.

FIG. 2 illustrates the same mechanism and elements shown in FIG. 1 except that the body portion 3 has been laid open to better illustrate the left hand portion 3*a* and right hand portion 3*b* of the mechanism 1. Mounted within the left hand portion of the cylindrical passageway 5*a*, there is integrally contained and held by the cylindrical wall a toothed surface 7 suitable for gripping one side of a line.

Diametrically opposed to the toothed surface 7 is a cam 9 having toothed surfaces 11-u and 11-l adapted to engage the side of a line.

The cam 9 is pivoted for rotation around pivot pin 13 whose axis is at right angles to the axis of passageway 5.

Radially positioned on the other side of the cam 9 and attached thereto is a hand operated lever 15. Movement of the lever 15 rotates the cam around pivot 13 and moves the toothed surfaces 11-u and 11-l variously toward or away from the axial center line of the passageway 5.

Mounted for rotation with handle 15 is a line keeper 17 having an upper finger or tine 19-u and a lower finger or tine 19-l. Included in the lower portion of the line controlling mechanism 1 are hooks 21 suitable for attaching a seat or other body encompassing harness. Snaps 23 are spring biased to permit a ring to be inserted into the seat hooks 21 but prevent them from accidentally sliding out of the seat hooks 21.

Figure 3:
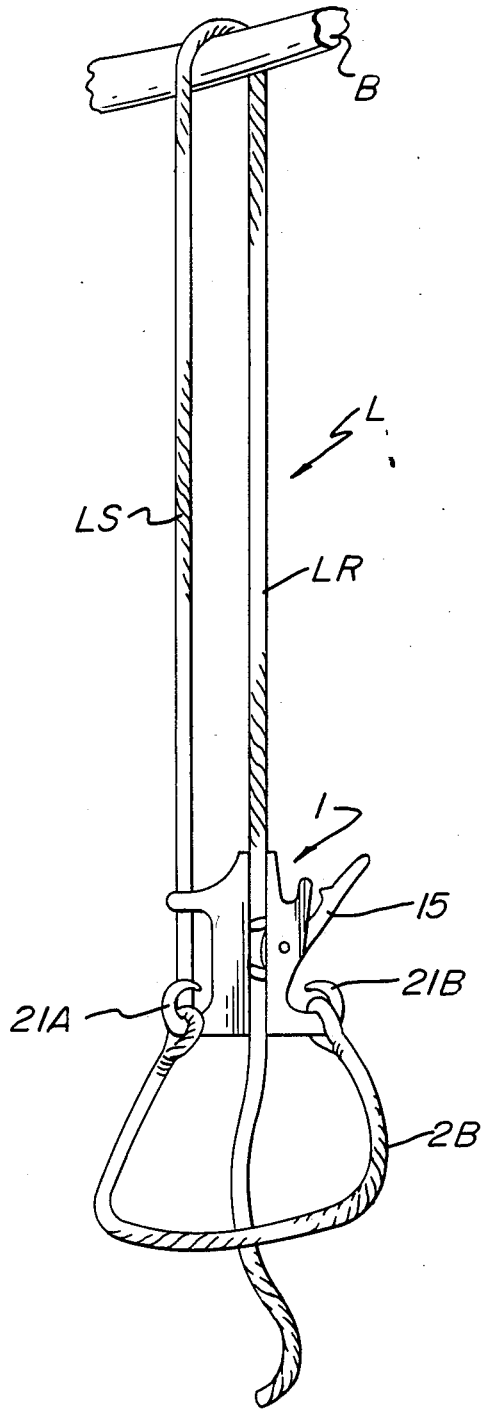
FIG. 3 is a perspective view of a hand operated line controlling mechanism of this invention installed in place for a man to climb a tree.

A line guide 25 is provided at the top of the line controlling and securing mechanism 1 which may function as a point to which the standing portion of a line may be anchored. Alternatively, the line L may be threaded through guide 25, seat hook 21A and secured on seat hook 2B as shown in FIG. 3.

The means of engaging or disengaging the bite of a line is schematically illustrated in FIGS. 5, 6 and 7. Assuming that one wants to engage the bite of a line L, the line is laid along the axis of the cylindrical passageway 5 while the handle 15 is released. Note that the bias of spring 27 will urge the handle 15 to move in a clockwise direction. When the handle is in this fully clockwise position, as illustrated in FIG. 4, the finger 19-u is rotated away from the side opening in passageway 5. This permits the line L freely to be inserted into the upper portion of the passageway 5. Once this is done, the lever 15 is grasped and moved against the bias of spring 27 in a counter-clockwise direction as can be seen in FIG. 6, this rotation causes the upper finger 19-u to move over the surface of partially inserted line L and seat it within the upper portion of passageway 5. At the same time, the lower finger 19-l moves away from the front of the opening in passageway 5 permitting the line L to seat in the lower portion of passageway 5. At this point, the line L will be wholly contained the passageway 5 and, when the lever 15 is relaxed, the spring bias will rotate the device in a clockwise direction until the lower toothed surface 11-l of the cam 9 rests against the side of line L. This position is illustrated in FIG. 6 and it can be seen that both the upper finger 19-u and the lower finger 19-l of the line keeper 17 prevent the line l from moving out of the axial passageway 5 of the line controlling and securing mechanism 1 of this invention.

In operation, after the line L has been seated within the cylindrical passageway 5, the lower toothed portion 11-l of the cam 9 will be held engaged with the line L due to the bias of spring 27. The point of rotation or pivot point of the cam 9 is eccentrically located with respect to the toothed surfaces 11-l and 11-u so that, with the orientation shown in FIGS. 1 and 2, an upward pull of a line 1 (or the downward pull of the mechanism 1) will cause the lower toothed surface of 11-l of the cam 9 to rotate in a clockwise direction forcing the line against the toothed surface 7. It can be understood that by this arrangement the harder the upward (or downward) pull, the more tightly the line L will be engaged by the opposed toothed surfaces 7 and 11-l.

On the other hand, when an upward force is applied to the line controlling and securing mechanism 1, the eccentric nature of the cam 9 is such as to cause the toothed surface 11-l to move in a clockwise direction and relieve its grip in combination with the toothed surface 7 on the line L. This grip on the line can also be relieved by grasping the lever 15 and squeezing it toward the mechanism 1. This will also cause the cam to rotate in a counter-clockwise direction and release its grip on the line of toothed surface 11-l. When the lever 15 is squeezed toward the mechanism 1 to rotate the cam in a counterclockwise direction, the line L will be free to pass without restraint in either direction through the cylindrical passageway 5. However, if the handle 15 is more tightly squeezed and moved still further toward the axis of the line controlling and securing mechanism 1, the cam will rotate in a counter-clockwise direction until the upper cam surface 11-u seats in gripping relationship with the line L.

The function of the upper toothed surface 11 of cam 9 is solely to provide safety of operation in case a person using the mechanism 1 should panic. For example, if the device were being used as an escape mechanism by a person to lower himself from an upper floor of a burning building, the device is designed to let the person lower himself at a controlled rate by gripping the handle 15 and releasing, at least in part, the gripping force of the lower toothed surface 11-l from the rope. The rate of decent can be controlled by feathering the lever 15; that is squeezing a little harder to increase the rate of descent and easing the pressure on lever 15 to slow down the rate of descent. However, it may be anticipated that when the device is used in an emergency, the user, if falling too rapidly may, as by an instinctive reaction, clutch harder on the handle 15 rather than release it to stop the downward descent. If this should happen, the device is designed so that the upper toothed surface 11 will engage the line L and slow or stop the descent of the user even though he panics.

FIG. 3 illustrates one environment in which the device of this invention can be used. Here there is shown a tree T with a branch B over which has been thrown a line L. A seat S, such as is suitable to support a man, is secured at its elevation by means of the line controlling and securing mechanism 1 of this invention. The seat S is equipped with "D" rings D which are hooked over seat hooks 21 of the line controlling and securing mechanism 1. The standing part of the line L is securely fastened to the line hook 25 and the running part of the line 1r is passed through the cylindrical passageway 5 and secured therein by the fingers 19-u and 19-l.

In practice, as best can be understood from FIG. 3, a sling type seat can be attached by means of "D" rings D to the hooks 21A and 21B and the standing portion of the line LS is then secured, onto the line guide 25. Alternatively, the standing part of line LS can be passed through guide 25, looped through hook 21A and dead ended on hook 21B. The handle 15 is released allowing the cam to rotate in a clockwise direction and remove upper finger 19-u from in front of the cylindrical passageway 5. A bite of line L is then laid into the upper portion of the cylindrical passageway 5, the handle 15 is gripped and rotated in a counter-clockwise direction until the lower finger 19-l is moved from in front of the passageway 5 and the bite on the line L is inserted the rest of the way into the passageway 5. The handle 5 is then released, and because of the spring bias, the cam 9 and the fingers 19-u and 19-l are rotated clock wise until both fingers 19-u and 19-l are positioned over the passageway 5 to secure the line L in the passageway 5. At the same time, the clockwise direction of the cam 9 moves the lower toothed surface 11-l into contact with the line L. The line controlling and securing mechanism of this invention 1 is now ready for use. If the user is going to climb a tree, as is a common practice for deer hunters, the running part LR of the line L is hauled in while the user braces himself against the tree T with his feet to transfer some of his bodily weight away from the seat S. This combined action permits the running part LR of the line L to be hauled in while the standing part LS is shortened which, overall, elevates the position of the seat S and the user. The user may now allow his full body weight to rest in the seat S but the rope cannot move in the opposite direction through the mechanism due to the eccentric axis around which the lower toothed portion 11-l of the cam 9 rotates. Conversely, however, when the user makes his next upward movement the relative movement of the line within the cylindrical passageway 5 will release the grip of the toothed surface 11-l and allow the line to move freely.

This process is repeated until the person climbs to a desired height.

To descend from the tree, all that need be done by the user is to squeeze on the lever 15 to release the lower toothed surface 11-l from locking engagement with the line L. As previously described, the downward descent may be feathered depending upon how hard the lever 15 is gripped but, if the user does panic and squeezes too hard, the upper toothed surfaces 11-u will rotate into contact with the rope and stop the descent.

For completeness of description the invention has been described primarily with respect to a device for climbing or descending. However, the device has more general utility and, for example, may be useful as a hand operated mechanism for paying out or hauling in most any type of line. It can be understood that if the device of this invention is not used to support a person as in ascending or descending a rope but is used solely to control hauling in or paying out line, some of the features of the device of this invention could be omitted. For example, if the line controlling and securing mechanism 1 is not going to be used to support a load such as a person, the seat hooks 21 and securing snaps 23 can be eliminated. Also, if the object being worked upon were tied to the end of a line, there would be no need for a line hook 25 to secure the standing part of a line. By way of further example, the line hook 25, the seat hooks 21 and the snaps 23 could be eliminated and, by means of suitable mounting brackets (not shown), the line controlling and securing mechanism of this invention could be secured to the deck of a boat. For example, the mechanism could replace (or be mounted upon) a deck cleat. Thus, for example, a purchase on a jib sheet could be obtained by inserting a bite on the sheet into the mechanism by rotating the keeper and its fingers as described above. Once a purchase is obtained, the jib sheet is secured from paying out but it can easily be hauled in. Due to the spring bias of the lever 15, once the sheet is hauled in to the desired amount and released, the mechanism will automatically lock up and prevent the sheet from paying out. On the other hand, the sheet can be allowed to run by squeezing the handle 15. As soon as the handle is released, the spring action will rotate the handle in a clockwise direction and further motion of the line will set the toothed surface 11-l against the sheet and prevent further motion.

It is to be understood that the line controlling and securing mechanism of this invention will be useful in many fields. Not only may it be used to climb trees but it may be used to climb buildings, it may be used by window washers to aid in climbing and descending the sidewalls of buildings, it may be used by mountain climbers, it may be used in lieu of a boatswain's chair to climb and descend a mast, it may be used to secure mooring lines, lanyards, sheets and other nautical lines, it may be used as an escape mechanism from an elevated floor of a burning building, and it may be used in almost any application in which a hand held device is useful in paying out, hauling in or securing a line.

I claim:

1. Control apparatus to aid in hauling in, paying out or securing a line, comprising:

a body portion having a cylindrical passageway adapted to receive a line and permit the line to move axially through the passageway;

a side opening extending the axial length of the passageway adapted to accept the lateral insertion or removal of the bight of a line;

jaws having line engaging surfaces oppositely disposed within the passageway, including:

a first jaw fixedly positioned and defining a portion of the inside surface of the passageway;

a second jaw mounted for rotation about a pivot point located outboard of the passageway and adapted to be rotated sequentially, by cooperative interaction with the first jaw, from a first line engaging position, to an intermediate line disengaging position, to a second line engaging position;

spring bias means to urge the second jaw into the first line engaging position; and lever means fixed to the second jaw and mounted for rotation about the pivot point which, when rotated toward the control apparatus, will rotate the second jaw against the spring bias first into the line disengaging position and next into the second line engaging position.

2. Claim according to claim 1 wherein first and second rope guides extend radically from the pivot point for rotation over the side opening of the passageway and are spaced from each other at a distance such that the first guide will cover the side opening when no line is within the passageway and the lever is free to be moved by the spring bias, only the second of the guides will cover the side opening when the second jaw is in its second line engaging position; and both guides will cover the side opening when the second jaw is in either the intermediate line disengaging position or the first line engaging position.

3. Control apparatus to aid in hauling in or paying out line, comprising:

a central passageway aligned along a principal axis of the apparatus, the passageway being adapted to receive a ine and permit the line to move axially through the passageway; a side opening extending the entire axial length of the passageway adapted to accept the lateral insertion or removal of the bight of a line from the passageway; jaws having line engaging surfaces oppositely disposed within the passageway, including:

a fixed jaw axially extending, and having its line engaging surface defining a portion of an inside surface of the passageway;

a moveable jaw mounted for rotation about a pivot point located outboard and at right angles to the passageway and adapted to be rotated sequentially, by cooperative interaction with the first jaw, from a first line engaging position, to an intermediate line disengaging position and finally to a second line engaging position, the first and second line engaging positions being characterized in that the line engaging surfaces of the second jaw are in holding contact with the line; the intermediate line disengaging position being characterized in that the line engaging surfaces of the moveable jaw are out of contact with the line;

spring bias means to urge the moveable jaw into the first line engaging position; and lever means fixed to the moveable jaw and mounted for rotation about the pivot point which, when rotated toward the control apparatus, will rotate the moveable jaw against spring bias, into the second line engaging position;

a pair of rope guides radially extending from the pivot point, secured for rotation with the moveable jaw over the side opening of the passageway and spaced from each other at a distance such that:

one of the guides will cover the side opening when no line is within the passageway and the lever is free to move with the spring bias;

the second of the guides will cover the side opening when the moveable jaw is in its second line engaging position; and both guides will cover the side opening when the second jaw is in either the intermediate line disengaging position or the first line engaging position.

4. Control apparatus according to claim 3 wherein two hooks depend from the apparatus to receive body supporting apparatus.

5. Apparatus according to claim 3 including an appendage to the body portion of the apparatus onto which the end of a line can be secured.

* * * * *